US005285428A

United States Patent [19]

Rosow et al.

[11] Patent Number: 5,285,428

[45] Date of Patent: Feb. 8, 1994

[54] SWIMMER'S LAP COUNTER

[76] Inventors: Eric Rosow, 42 Baldwin Ct., Newington, Conn. 06111; Saunders Whittlesey, 89 Walbridge Rd., West hartford, Conn. 06119

[21] Appl. No.: 792,933

[22] Filed: Nov. 15, 1991

[51] Int. Cl.[5] ..... G04B 19/24; G04F 8/00

[52] U.S. Cl. ..... 368/107

[58] Field of Search ..... 368/10, 107; 340/323 R; 200/252 R; 272/4, 7, 105

[56] References Cited

U.S. PATENT DOCUMENTS

| | | |
|---|---|---|
| 3,363,243 | 1/1968 | Morley et al. . |
| 3,510,631 | 5/1970 | Weinberg et al. . |
| 3,544,989 | 12/1970 | MacCreadle . |
| 3,676,696 | 7/1972 | Leu et al. . |
| 3,678,496 | 7/1972 | Stalp . |
| 3,784,768 | 1/1974 | Hunt . |
| 3,916,214 | 10/1975 | Coble, Jr. et al. . |
| 3,920,940 | 11/1975 | Brown et al. . |
| 3,944,763 | 3/1976 | Beierwaltes . |
| 4,263,736 | 4/1981 | Beierwaltes et al. . |
| 4,475,016 | 10/1984 | Berger . |
| 4,476,358 | 10/1984 | Capecchi . |
| 4,518,266 | 5/1985 | Dawley . |
| 4,530,105 | 7/1985 | Rabinowitz . |
| 4,700,369 | 10/1987 | Siegal et al. . |
| 4,757,453 | 7/1988 | Nasiff . |

OTHER PUBLICATIONS

Penwalt Corp., Kynar Piezo Film Technical Manual.

*Primary Examiner*—Bernard Roskoski

[57] ABSTRACT

A swimmer's lap counter for registering the number of laps traversed by a swimmer in a pool. The counter includes a waterproof housing containing a control and display unit, which floats in a pool and is anchored to the pool edge. A piezoelectric touch pad descends therefrom and extends below the water line. Deformation of the touch pad increments the counting circuit, the current numerical state of which is displayed from the housing in a manner easily readable by the swimmer. A variety of alternative anchoring fixtures for retaining the housing at or near the edge of the pool are disclosed. In a first embodiment, the housing is coupled, preferably via an adjustable tether, to a conformable bracket that the user accommodates to the pool edge or coping such that the housing (and the touch pad coupled thereto) rest flush against the pool wall. The bracket may itself be coupled to a water bladder for stability or, in a second embodiment, have sufficient length retain position by frictional contact with the pool deck. In a third embodiment, suitable for pool-edge configurations that include integral drainage troughs, the tether is coupled directly to the water bladder. In a fourth embodiment, the housing is tethered directly to the pool edge.

14 Claims, 9 Drawing Sheets

SWIMMER'S LAP COUNTER

BACKGROUND OF THE INVENTION

Field of the Invention

The present invention relates generally to monitoring of athletic activities, and in particular to a counting device for registering the number of laps traversed by a swimmer in a pool.

Description of the Related Art

Well-conditioned swimmers can cover tens or even hundreds of laps up and down the length of a pool during competitions or when training. Naturally, the repetitive nature of the activity can make it difficult and confusing to keep track of the number of laps swum. A variety of counting devices therefore have been developed to monitor swimmers' progress. A typical device features a touch-sensitive switch coupled to an instrument that counts the number of times the switch is actuated. The switch is suspended at one end of the pool, and increments the counter each time the swimmer makes contact with the switch.

Of course, the switch must be both waterproof and accessible to the user, and it should respond to a minimal amount of pressure (the minimum being slightly more than that caused by waves in the pool). Because the device itself is generally affixed to the edge of the pool during use, its construction should be amenable to a wide variety of different edge designs (particularly those that include coping, i.e., extensions of the pool deck over the water). It should also contain a display visible to the swimmer, and be easily transported.

Although the prior art includes numerous lap-counting devices, none fully meets the requirements just stated. For example, U.S. Pat. No. 4,700,369 (to Siegal et al.) describes a lap counter in which the switch consists of a pair of rigid, spaced, facially confronting, electrically conductive plates, and is activated by contact with a face plate. In U.S. Pat. No. 3,676,696 (to Leu et al.), the switch is based on use of a transducer that senses vibrations from a metal plate; the swimmer must strike this plate in order to produce the vibrations necessary to increment the counter. The device described in U.S. Pat. No. 4,518,266 (to Dawley) requires flexure of a kickpad to activate a mechanism inside a waterproof housing. Perhaps due to the need to maintain the switch components in a water-tight environment, each of these prior-art devices necessarily requires application of considerable pressure to the switch in order to increment the counter.

The aforementioned devices, as well as the device described in U.S. Pat. No. 3,944,763 (to Beierwaltes), have design features that limit their use in different types of pools. The Leu et al. and Beierwaltes devices require permanent fixation to the pool wall, and therefore cannot be transported. The device described in the Siegal et al. patent was plainly designed for right-angle edges, and cannot engage either coping or many gutters; this limitation is illustrated in FIGS. 5–7 of the patent. Similar constraints apply to the Dawley counter.

DESCRIPTION OF THE INVENTION

Objects of the Invention

Accordingly, it is an object of the present invention to provide a swimmer's lap counter that can be temporarily affixed by hand to virtually any pool edge.

It is another object of the invention to provide a swimmer's lap counter that has a large contact area and requires only minimal pressure to be incremented so as not to require a conscious effort on the part of the swimmer.

It is a further object of the invention to provide a swimmer's lap counter that is easily transported.

It is yet another object of the invention to provide a swimmer's lap counter that contains a display readily viewed by the swimmer.

Other objects will, in part, be obvious and will, in part, appear hereinafter. The invention accordingly comprises an article of manufacture possessing the features and properties set forth in the constructions described herein, all as exemplified in the following summary and detailed description, and the scope of the invention will be indicated in the claims.

Brief Summary of the Invention

In accordance with the present invention, a waterproof housing that contains a control and display unit floats on the surface of the water and is tethered to the pool edge. A piezoelectric touch pad descends therefrom and extends below the water line. The touch pad is electrically coupled to a counting circuit contained within the housing, such that even relatively light contact between a swimmer and the touch pad increments the counting circuit. The current numerical state of the counting circuit is displayed from the housing in a manner easily readable by the swimmer.

The invention provides several alternative anchoring fixtures for retaining the housing at or near the edge of the pool. In one embodiment, the housing is coupled, preferably via an adjustable tether, to a conformable bracket that the user accommodates to the pool edge or coping such that the housing (and the touch pad coupled thereto) rests substantially flush against the wall of the pool. The bracket may itself be connected to a massive weighting member for stability; in the preferred version of this embodiment, a bladder that can be filled with water is employed as both the weighting member and as a carrying case. In an alternative embodiment, positional stability is maintained using a conformable bracket of sufficient length to resist movement by frictional contact with the pool deck.

In a third embodiment, suitable for either simple right-angle pool edges or edge configurations that include integral drainage troughs, the housing is tethered directly to the stabilizing member.

In a fourth embodiment, the housing is tethered directly to hardware, such as a drainage grate or the leg of a starting block, near the pool edge.

The primary function of the anchoring system described above is to prevent the device from drifting. It need not support the weight of the display unit and touch pad because they float in the pool. Additionally, the touch pad will not tend to move upon contact by a swimmer because of frictional forces between the pad and the pool wall. The only realistic way a swimmer can exert any sizable force on the anchoring is to strike the top of the housing; for this reason, the tether should be elastic to allow the housing to spring downward, thereby limiting the effective force applied to the anchoring system as well as preventing damage to the housing.

Because of the thinness and flexibility of the touch pad, it can be rolled around the housing; in the embodiments containing the water bladder, the rolled-up unit can be stored within the empty bladder.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE INVENTION

Figure 1:
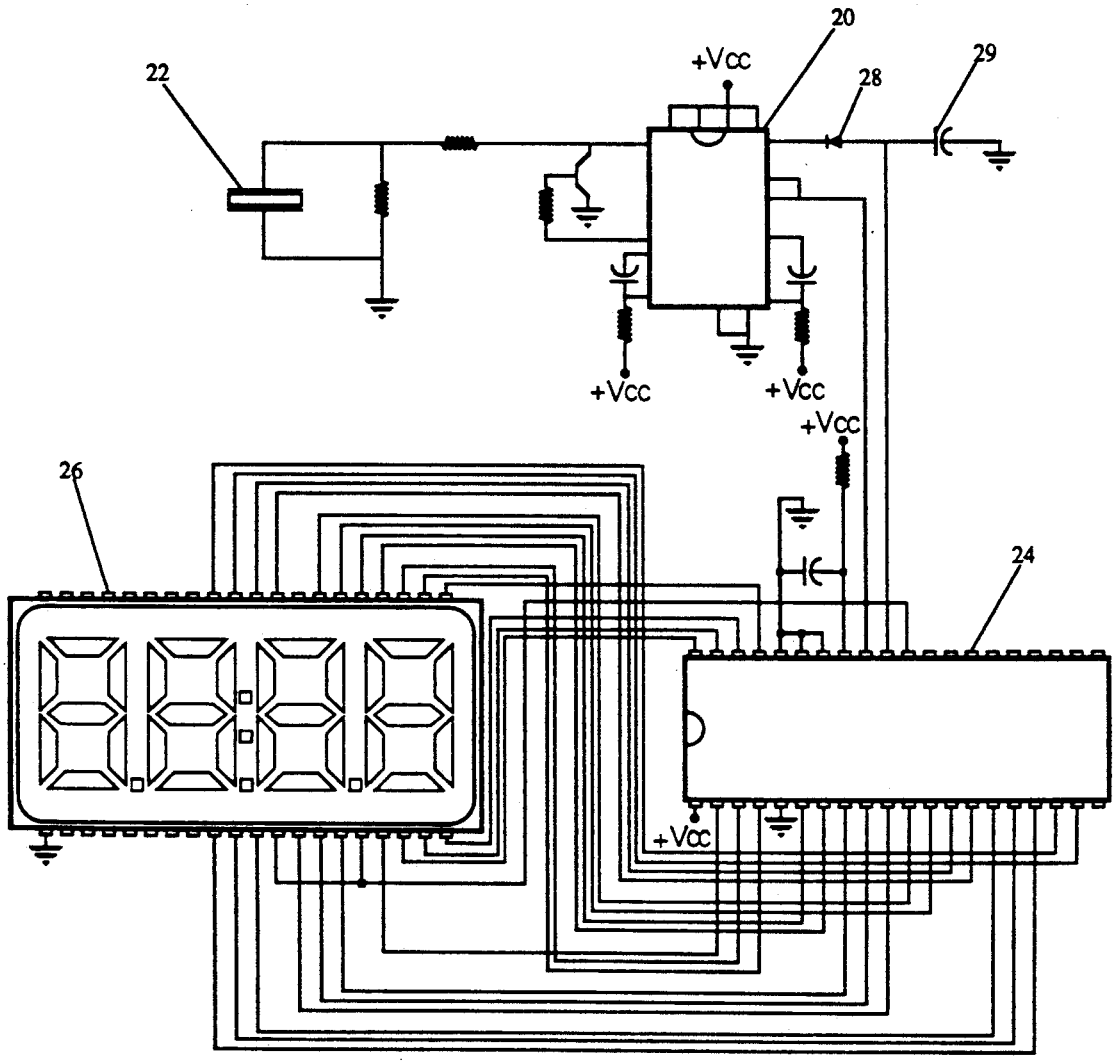
FIG. 1 is a circuit diagram that schematically illustrates a suitable electrical counting circuit.

Refer first to FIG. 1, which schematically illustrates a counting circuit suitable for use with the present invention. The circuit includes an interface chip 20, which is connected to and activated by a piezoelectric touch pad 22. The material of touch pad 22 preferably exhibits high enough piezoelectric activity to generate an appropriate electrical response when struck lightly by a swimmer, yet sufficient insensitivity to avoid improper actuation by the stresses induced by wave motion in the pool. We have found that the piezoelectric film marketed by Pennwalt Corp., Valley Forge, Pa. under the name KYNAR fulfills these electrical requirements. The physical characteristics and dimensions of touch pad 22 will be described in greater detail below.

Interface chip 20 transforms the noisy signal generated by touch pad 22 into a clean pulse that is easily counted by a counter/driver chip 24, which in turn drives the display 26. Although display 26 is preferably a liquid-crystal unit to minimize power consumption, the precise characteristics of display 26 are not critical. The display numerals should be large enough for an approaching swimmer to read without inconvenience.

It is also appropriate to suppress the response of the counting circuit for a small period of time after an increment, because a swimmer might make more than one contact with touch pad 22 after completing a lap. For example, a typical recreational swimmer touches the pool wall with a hand upon completing a lap and then starts the next lap by pushing off with the feet. To prevent such activity from being counted as more than a single lap, a response delay of about 15 seconds is generally adequate, while still being far too short a time for an individual to complete another lap. Our delay circuitry consists of a diode 28 and a capacitor 29 appropriately interposed between interface chip 20 and counter/driver chip 24; the latter increments in response to changes in voltage. The capacitor and internal resistance within driver chip 24 combine to form an RC timing circuit, suppressing the voltage change necessary for increment of the display while capacitor 29 discharges. Capacitor 29 is charged through diode 28, which in turn prevents the capacitor from discharging via the charging path. Proper parameters for diode 28 and capacitor 29, as well as examples of other suitable circuitry, will be readily apparent to those skilled in the art.

Figure 2:
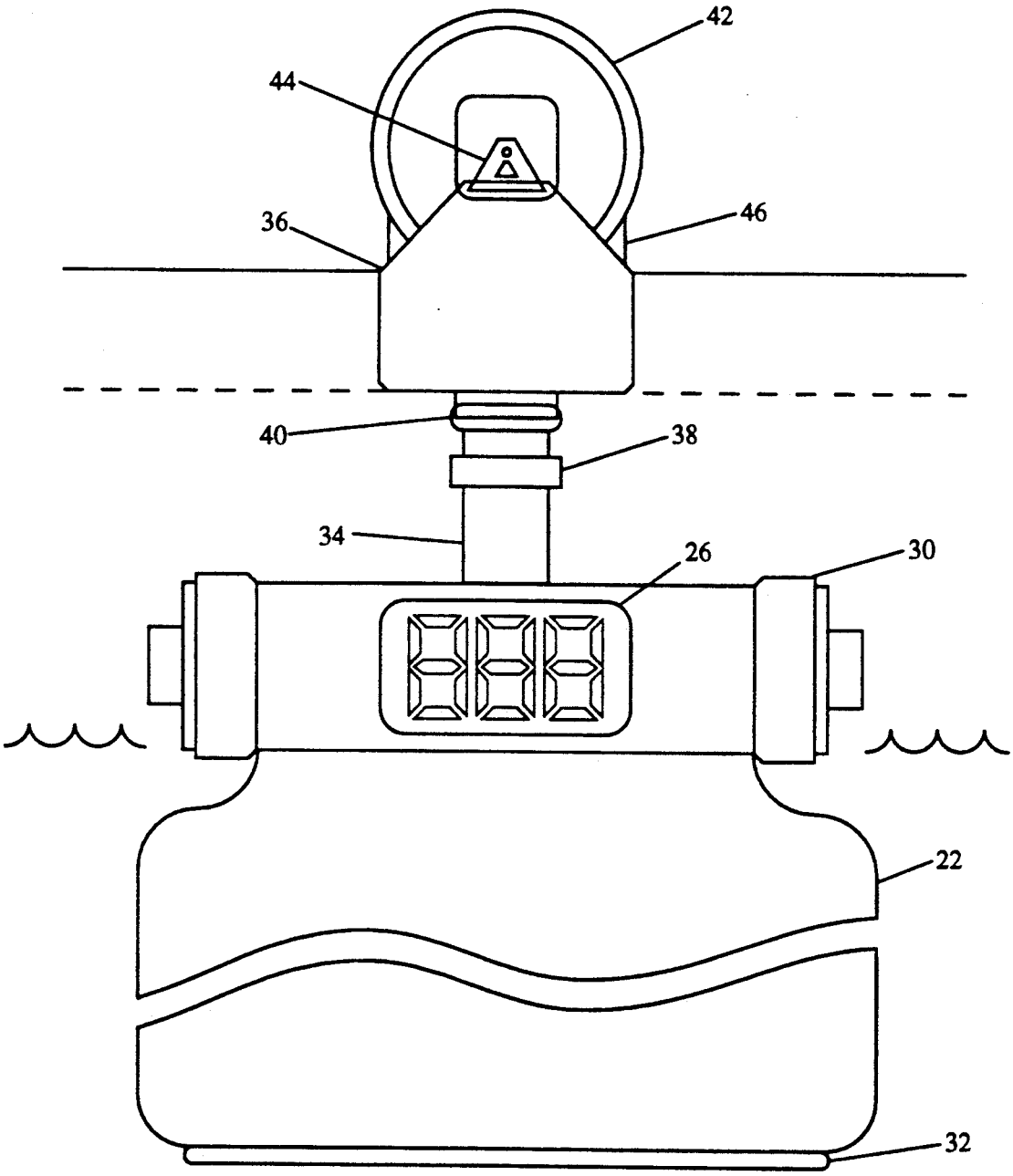
FIG. 2 is a front perspective view of the first embodiment of the invention, which employs a water bladder for stability.

FIG. 2 illustrates the first embodiment of the invention, which utilizes a water bladder for positional stability. As shown in this figure, a housing 30, which contains the counting circuitry illustrated in FIG. 1, floats on the surface of the pool water. Touch pad 22 is suspended therefrom and electrically connected thereto; it descends below the water line and is maintained in an outstretched position by a sinker rod 32. Because touch pad 22 is preferably fabricated from a single sheet of piezoelectric material, its dimensions and shape can be varied to optimize operational effectiveness, transportation convenience, and aesthetic appearance. For example, the larger the size of touch pad 22, the more accessible it will be to a swimmer, reducing the need for a conscious effort to strike the pad while executing a flip turn.

The material of touch pad 22 preferably exhibits sufficient toughness to withstand swimmer contact over a reasonable useful life, enough flexibility to wrap around housing 30, sufficiently light weight for convenient transportation, and resistance to elements of a pool environment (especially sunlight and chlorine). We have found that the KYNAR film mentioned above fulfills these requirements, and a preferred maximum thickness for touch pad 22 is 0.25 inch. An additional degree of reliability can be achieved by encasing the KYNAR film in a material specifically designed for pool environments, i.e., resistant to the effects of sunlight and chlorine. One suitable material is that marketed by Recreonics Corp., Indianapolis, Ind. under the name DELIFOL.

An adjustable tether 34, which is preferably elastic, couples housing 30 to a conformable bracket 36. Tether 34 may be adjusted, for example, by means of a buckle 38, and the connection between the tether 34 and bracket 36 may be conveniently established by a snap-in joint 40. Bracket 36, which the user accommodates to the pool coping by molding it around the contour of the coping, is connected to a water bladder 42 by means, for example, of another snap-in joint 44. If water bladder 42 is cylindrical, as shown in the figure, it preferably has a foot 46 or other stabilizing member to prevent rolling.

Figure 3:
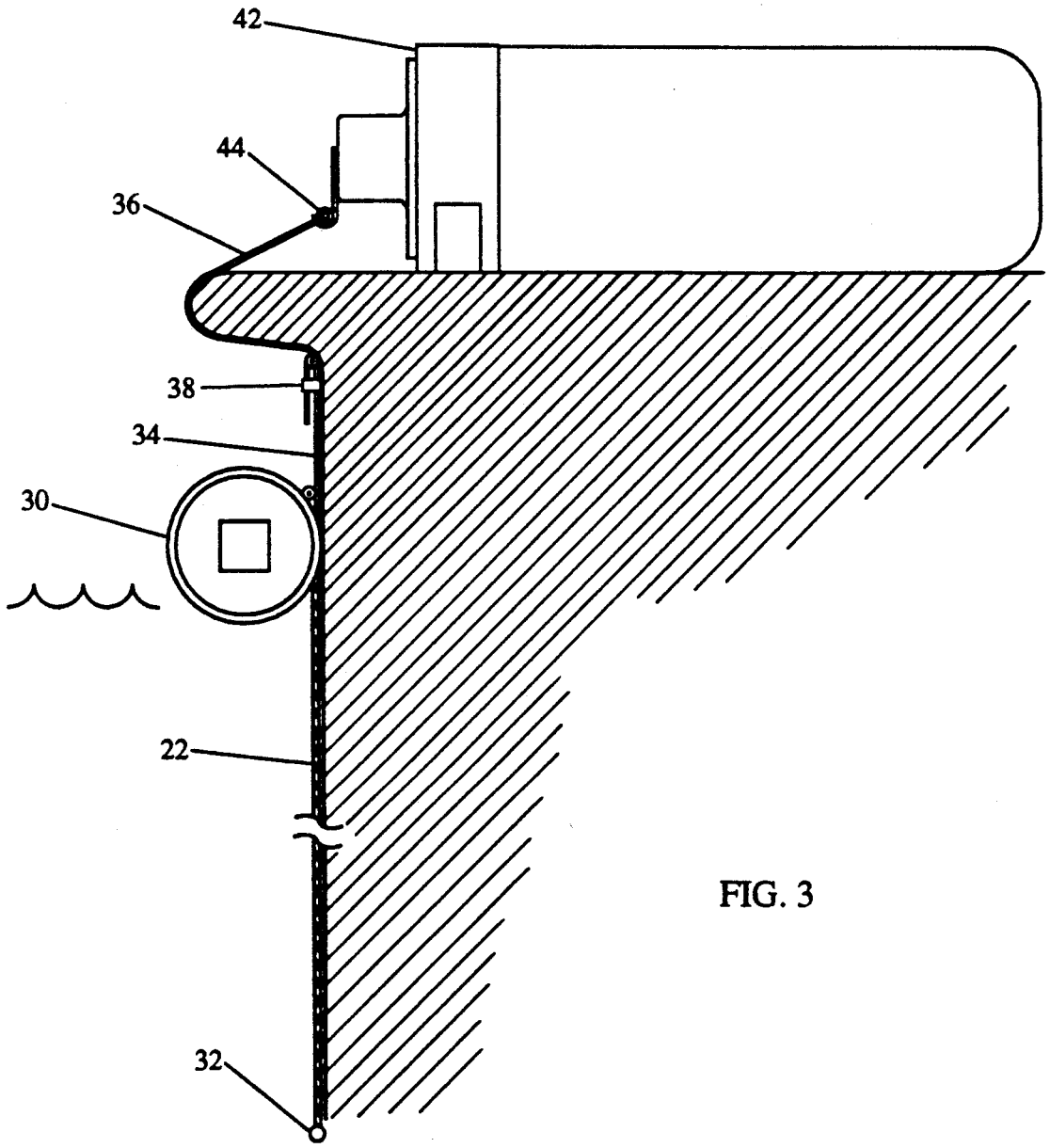
FIG. 3 is a side view of the embodiment illustrated in FIG. 2.

FIG. 3 provides a side view of the first embodiment, and illustrates the importance of conformable bracket 36 in maintaining touch pad 22 flush against the pool wall. After the user molds the bracket 36 around the pool coping, he or she couples it to bladder 42, which has been filled with water, by means of snap-in joint 44. Water bladder 42 serves as an anchor that prevents the other elements of the assembly from wandering forward or laterally.

Figure 4:
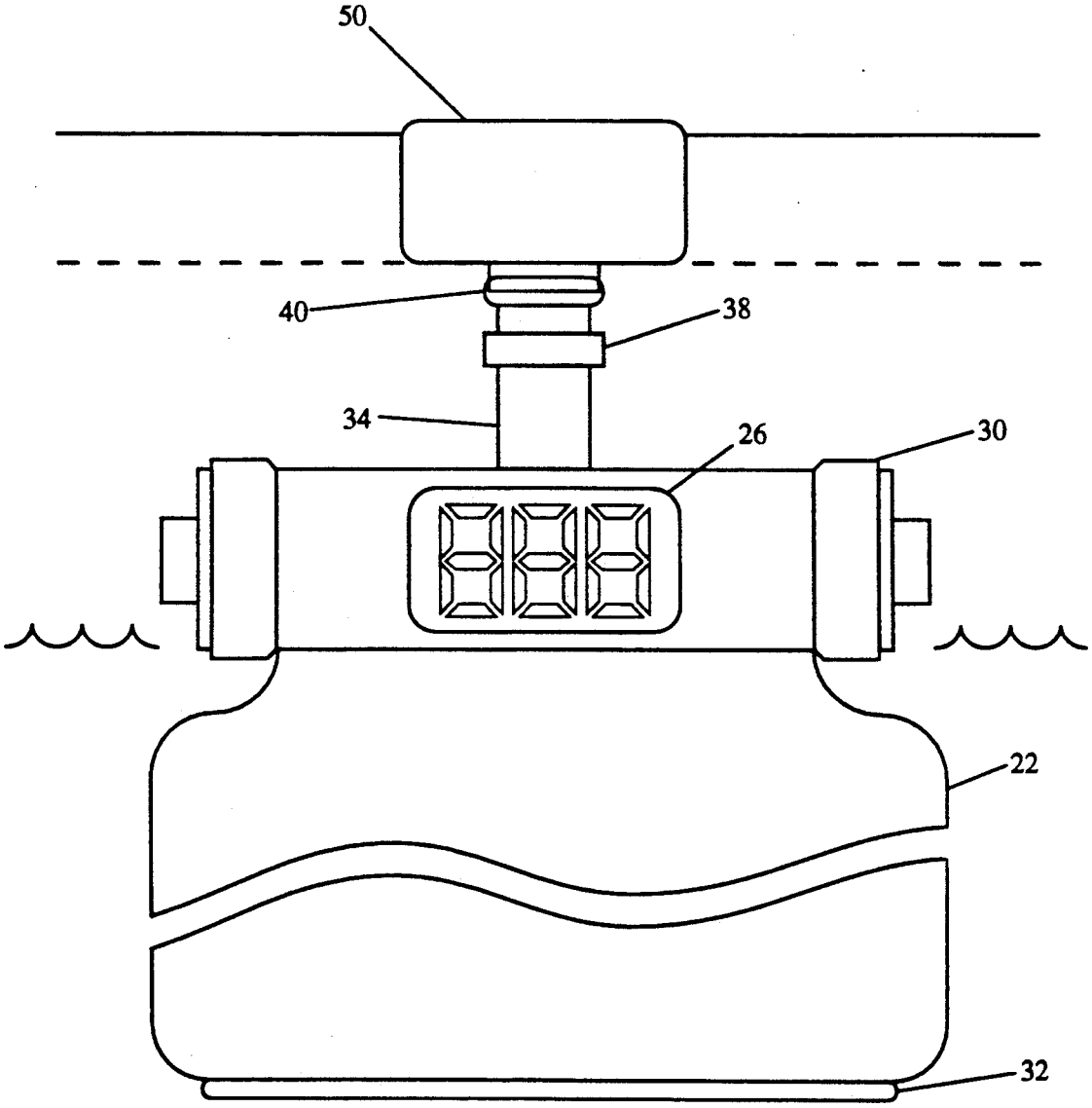
FIG. 4 is a front perspective view of the second embodiment of the invention, in which the conformable bracket is of sufficient length to provide stability through frictional contact with the pool deck.
Figure 5:
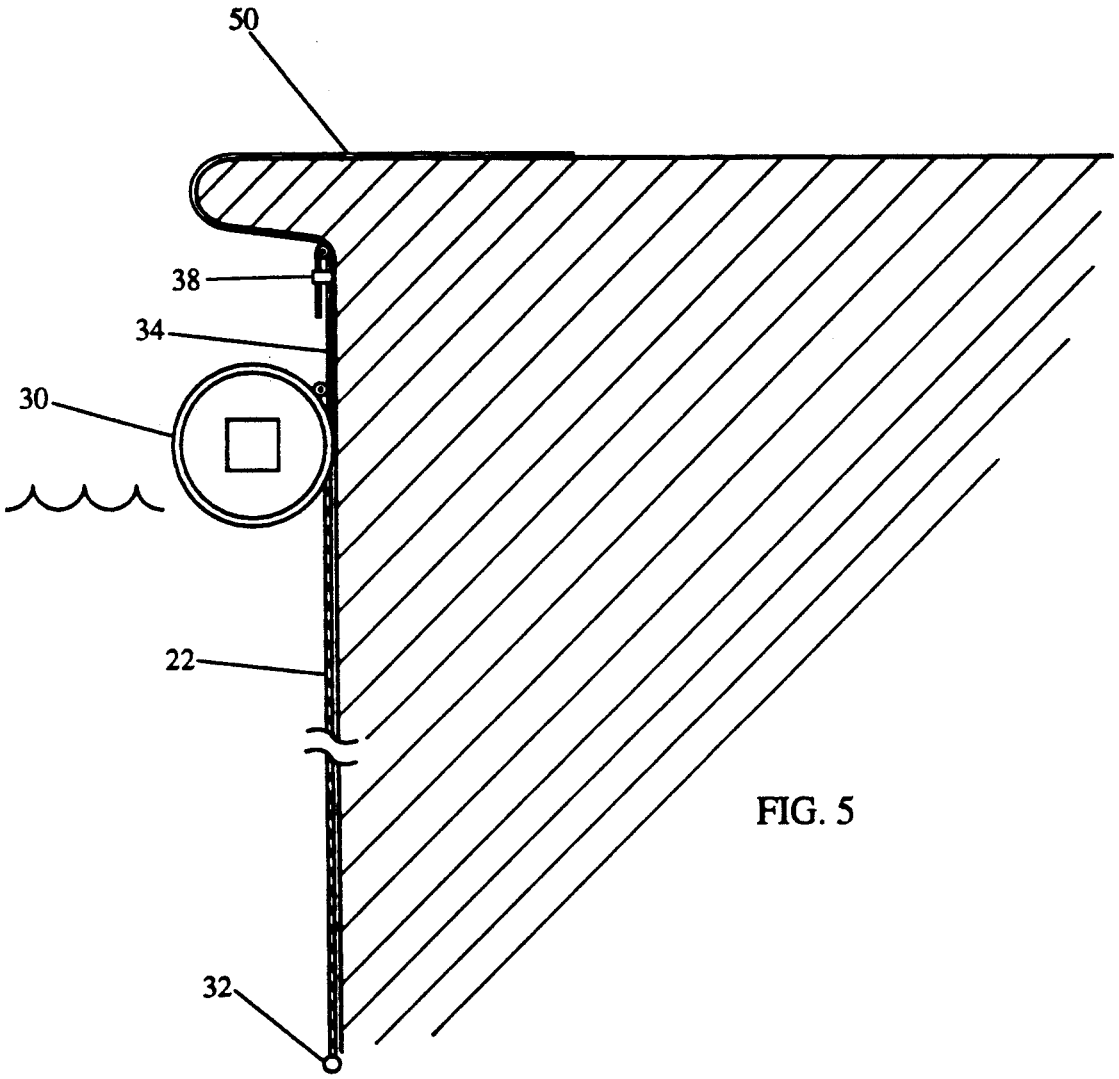
FIG. 5 is a side view of the embodiment illustrated in FIG. 4, and shows the elongated bracket.

The second embodiment of the invention is shown in FIGS. 4 and 5. In this version, the water bladder is eliminated, and the housing maintained in position by an enlarged conforming bracket 50. The enlargement of the bracket is shown with greatest clarity in FIG. 5; although its precise length (and consequent extension over the pool deck) is not critical, that length is sufficient to prevent slippage.

Figure 6:
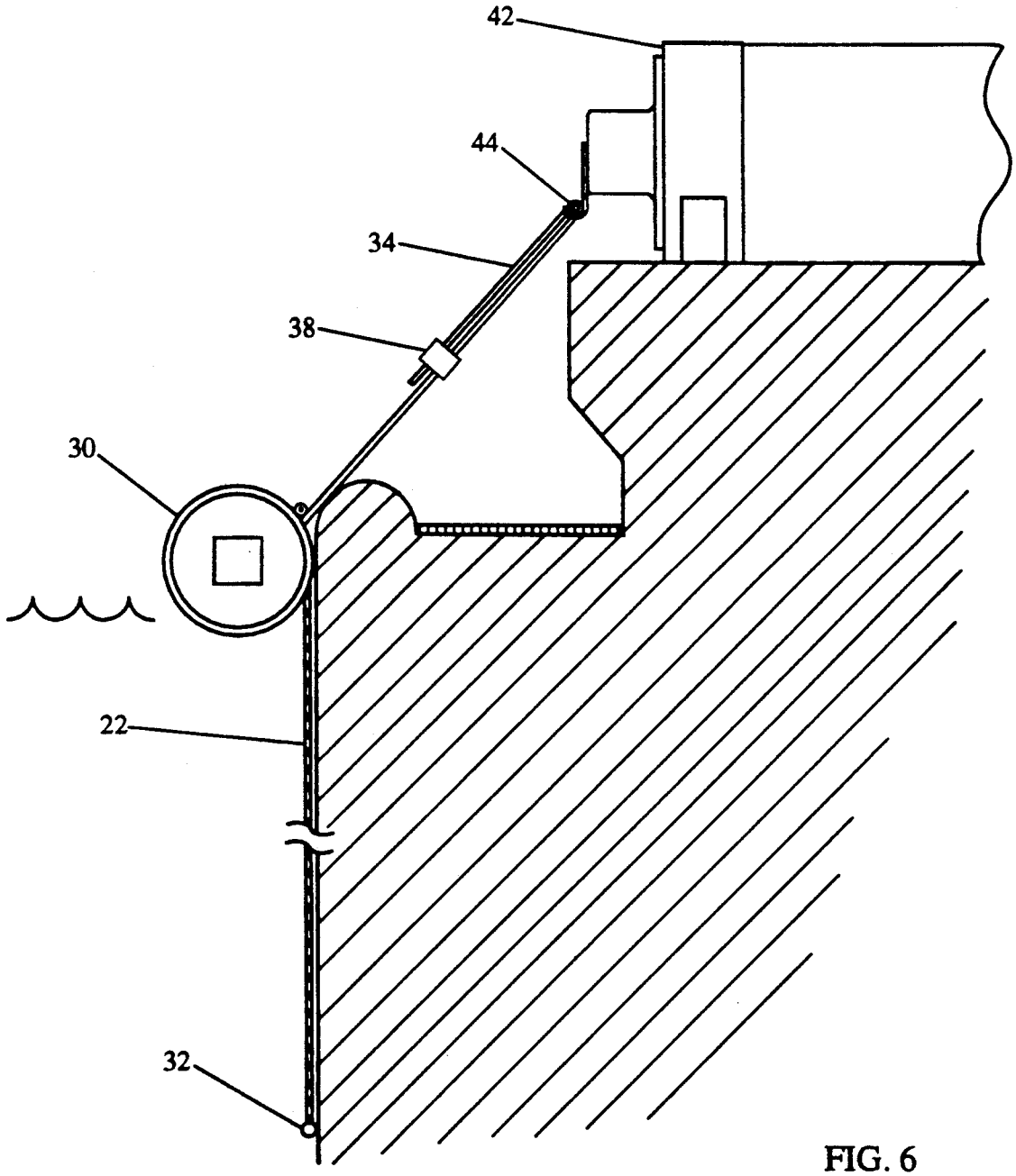
FIG. 6 is a side view of the third embodiment of the invention, in which the housing is coupled directly to the water bladder across a drainage trough.

FIG. 6 is a side view of the third embodiment, which provides anchorage over pool edges that include integral drainage troughs. In this version, the conforming bracket has been eliminated, and water bladder 42 connects directly to tether 34 via snap-in joint 44. This configuration is suitable for virtually any edge that does not include coping, such as a simple right-angle edge.

Figure 7:
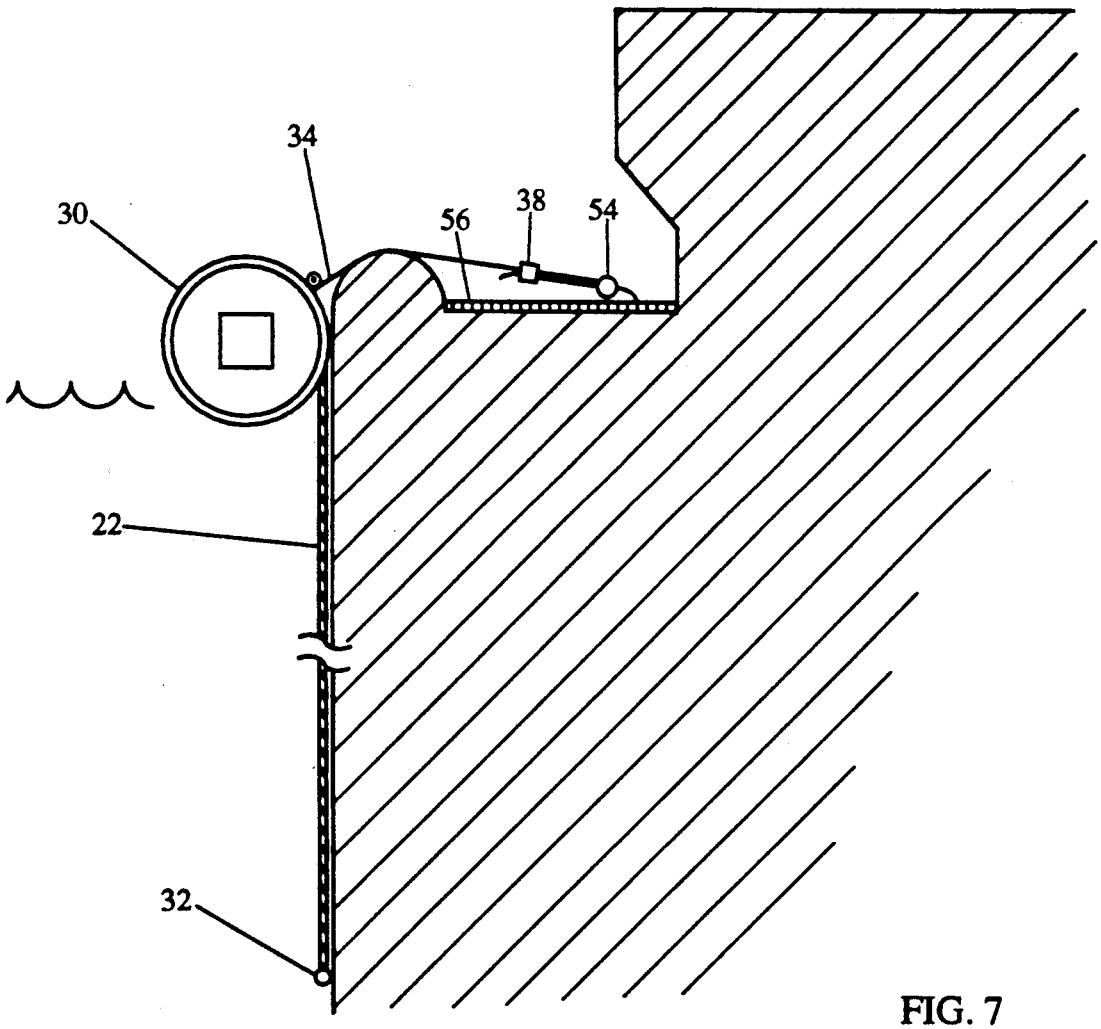
FIG. 7 is a side view of the fourth embodiment of the invention, in which the housing is coupled to a drainage grate.
Figure 8:
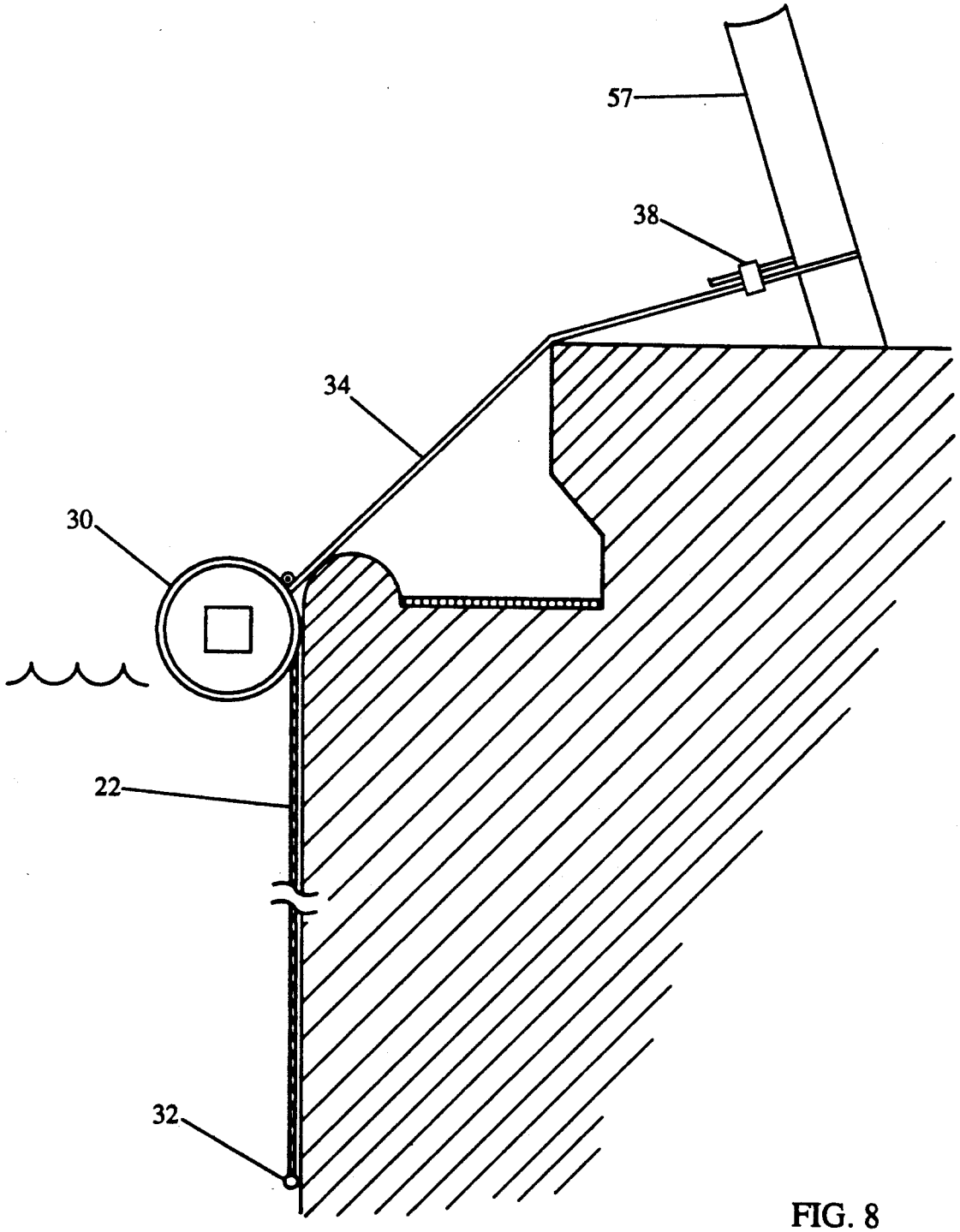
FIG. 8 is a side view of the fourth embodiment of the invention, in which the housing is coupled to the leg of a starting block.

Side views of the fourth embodiment are illustrated in FIGS. 7 and 8. In FIG. 7, the housing 30 is tethered directly to the pool grating 56 by means of a hook 54. FIG. 8 shows how the tether 34 can be looped around a starting block post 57.

Figure 9A:
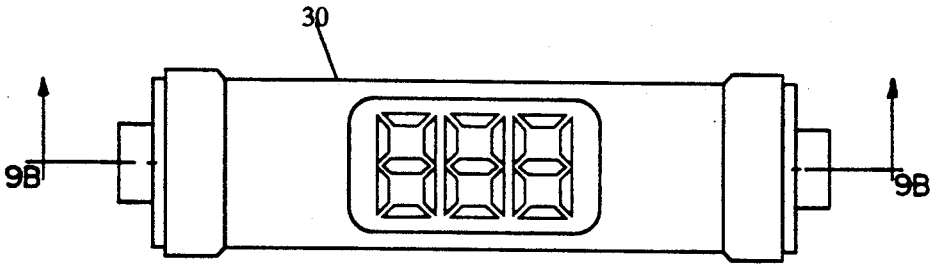
FIG. 9A is a front view of the housing.
Figure 9B:
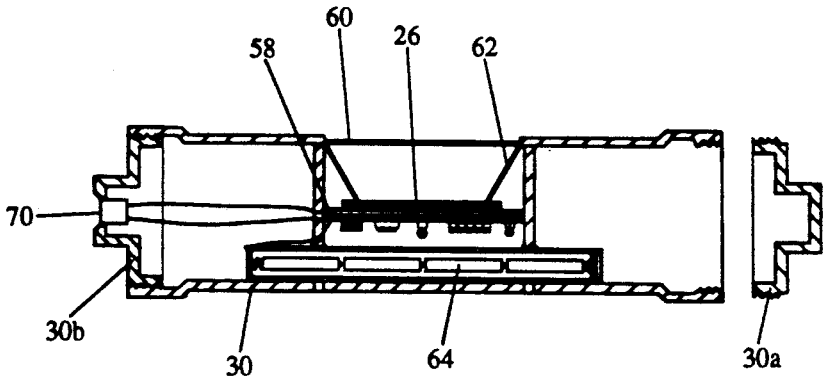
FIG. 9B is a sectional view of the housing, taken along the line 9B—9B of FIG. 9A.

FIGS. 9A and 9B are front and sectional views, respectively, of housing 30, showing its components and internal construction in detail. Specifically, FIG. 9A illustrates the view of the housing that would be observed by an approaching swimmer, and FIG. 9B is a cross-section taken along the line 9B—9B in FIG. 9A. As shown in FIG. 9B, housing 30 includes a center portion flanked by two caps 30*a*, 30*b*. The display 26 is mounted, along with the counting circuitry, to a circuit board 58 (which is also connected to touch pad 22, not shown), and is visible through a transparent (e.g., acrylic) window 60. The visual apparence of display 26 is enhanced by the presence of blocking walls 62, which flank display 26 on all sides to hide circuit board 58 from view as well as to limit interfering reflections on window 60. Power for the counting circuitry is provided by a bank of batteries 64, and operation of the circuitry itself is controlled by a recessed switch 70. Cap 30*a* is removable to allow access to battery bank 64, but cap 30*b* is permanently bonded to housing 30 to prevent damage to recessed switch 70.

Figure 10:
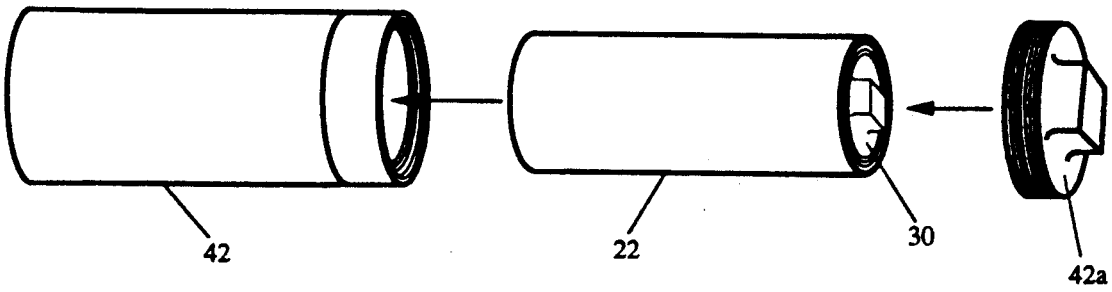
FIG. 10 illustrates the manner in which the components of the first embodiment of the invention can fit together to form a single unit for storage.

FIG. 10 illustrates the manner in which the components of the first or third embodiment can be stored as a single unit. With touch pad 22 rolled around housing 30, the assembly may be placed within the empty water bladder 42 (which, as shown in the figure, includes a main body and an end cap 42*a*). In the case of the first embodiment, which additionally contains the conformable bracket, water bladder 42 is of sufficient diameter to accommodate the housing, touch pad and bracket when rolled together.

It will therefore be seen that we have developed a versatile and convenient swimmer's lap counter that can be used in conjunction with a variety of pool designs. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A portable device for registering the number of laps traversed by a swimmer in a pool, the device comprising:
   a. a waterproof housing;
   b. a counting circuit contained within said housing;
   c. display means contained within the housing and electrically coupled to the counting circuit;
   d. a rollable touch pad comprising a substantially planar sheet of piezoelectric material electrically coupled to the counting circuit, such that deformation of the touch pad increments the counting circuit; and said pad and said housing forms a unitary waterproof device and
   e. a flexible bracket adjustably coupled to the housing, the bracket being of sufficient dimension and rigidity to conform to pool-edge coping and to retain position by frictional engagement with the coping.

2. The device of claim 1 further comprising means for retaining the touch pad in an outstretched configuration.

3. The device of claim 1 wherein the housing is configured to float on the surface of water in the pool, and the display means is disposed within the housing so as to be visible to an approaching swimmer.

4. The device of claim 1 further comprising delay means for suppressing response of the counting circuit for a predetermined time after increment.

5. The device of claim 1 wherein the sheet of piezoelectric material is encased in a material designed for use in pool environments.

6. A portable device for registering the number of laps transversed by a swimmer in a pool, the device comprising:
   a. a waterproof housing;
   b. a counting circuit contained with said housing;
   c. display means contained within the housing and electrically coupled to the counting circuit;
   d. a rollable touch pad coupled to the housing comprising a substantially planar sheet of piezoelectric material electrically coupled to the counting circuit, such that deformation of the touch pad increments the counting circuit; and said pad and said housing forms a unitary waterproof device and
   e. a massive stabilizing member coupled to the touch pad.

7. The device of claim 6 wherein the massive stabilizing member is a water bladder.

8. The device of claim 7 wherein the water bladder is adjustably coupled to the touch pad by means of a flexible bracket, which bracket is of sufficient dimension and rigidity to conform to pool-edge coping.

9. The device of claim 7 wherein the water bladder is coupled to the touch pad by means of an adjustable tether.

10. The device of claim 6 further comprising means for retaining the touch pad in an outstretched configuration.

11. The device of claim 6 wherein the housing is configured to float on the surface of water in the pool, and the display means is disposed within the housing so as to be visible to an approaching swimmer.

12. The device of claim 6 further comprising delay means for suppressing response of the counting circuit for a predetermined time after increment.

13. The device of claim 6 wherein the sheet of piezoelectric material is encased in a material designed for use in pool environments.

14. A portable device for registering the number of laps traversed by a swimmer in a pool, the device comprising:

a. a housing;

b. a counting circuit;

c. display means contained within the housing and electrically coupled to the counting circuit;

d. a rollable touch pad coupled to the housing comprising a substantially planar sheet of piezoelectric material electrically coupled to the counting circuit, such that deformation of the touch pad increments the counting circuit; and e. means for adjustably tethering the housing to hardware near an edge of the pool.

* * * * *